US005474279A

United States Patent [19]

Parisien

[11] Patent Number: 5,474,279

[45] Date of Patent: Dec. 12, 1995

[54] FENCE SYSTEM

[75] Inventor: Harvey E. Parisien, Kingston, Canada

[73] Assignee: Alcuf Inc., Ontario, Canada

[21] Appl. No.: 162,610

[22] Filed: Dec. 7, 1993

[30] Foreign Application Priority Data

Dec. 16, 1992 [CA] Canada ..... 2085531

[51] Int. Cl.[6] ..... E04H 17/14

[52] U.S. Cl. ..... 256/24; 256/65; 256/69

[58] Field of Search ..... 256/24, 59, 65, 256/68, 69, 21, 22, DIG. 5

[56] References Cited

U.S. PATENT DOCUMENTS

| | | | |
|---|---|---|---|
| 3,420,504 | 1/1969 | Mulitz | 256/22 |
| 3,522,933 | 8/1970 | Braun, III | 256/65 X |
| 3,770,245 | 11/1973 | Murdock | 256/24 |
| 3,847,489 | 11/1974 | Van Riper | 256/59 X |
| 3,924,834 | 12/1975 | Young | 256/59 X |
| 3,973,756 | 8/1976 | Lauzier | 256/65 X |
| 4,101,226 | 7/1978 | Parisien | 256/21 X |
| 4,114,860 | 9/1978 | Parisien | 256/21 X |
| 4,286,772 | 9/1981 | Parisien | 256/21 X |
| 4,306,631 | 12/1981 | Reusser | 256/24 X |
| 4,346,872 | 8/1982 | Tornya | 256/65 |
| 4,623,128 | 11/1986 | Dutch et al. | 256/24 X |

*Primary Examiner*—Dave W. Arola
*Assistant Examiner*—Harry C. Kim
*Attorney, Agent, or Firm*—Robert G. Hendry; Robert A. Wilkes

[57] ABSTRACT

The fence, sound barrier, guardrail or the like includes line posts and top and bottom rails for supporting panels, wire mesh, boards, pickets or fence material. A fence post cap and bracket is provided on the line posts, secured to the line post, and extending beyond the post so that a downwardly depending flange on the outer edge of the cap engages an outer side wall of the rail. The fence post bracket which is also secured to the line post supports the top rail and prevents upward displacement of the rail on the line post.

6 Claims, 4 Drawing Sheets

FENCE SYSTEM

This invention relates to construction of fences, barriers, guardrails or the like, and, more particularly, to a fence system including a fence post cap and bracket for securing fence rail to a fence post.

BACKGROUND OF THE INVENTION

In conventional fence construction, vertical fence posts are set in the ground around the area to be fenced. The upper ends of the fence posts are then joined by means of top rails which span the distance between posts. Bottom rails are necessary if material other than chain link wire fabric is used and the bottom rails are cut to fit between posts on site since spacing between posts is normally irregular or non-standard.

Attempts to provide fence or barrier systems wherein the fence rails are secured to the side of the upright line posts have not been entirely satisfactory for every fence or barrier requirement.

The original fence system of this type disclosed in U.S. Pat. No. 4,114,860 to R. Parisien disclosed a fence post cap including rails attached to the side of the line posts. However, the rails were designed to snap into place on the cap. The provision of larger more ridged caps and rails tended to interfere with this method of assembly. Furthermore, the post cap might move upwardly allowing fence material to be removed unless other devices are used to prevent unauthorized dismantling of the fence.

A further consideration in fence systems is providing a variety of materials for infill such as corrugated material, and pickets having aesthetic appeal. However, these materials require a wide channel member due to their thickness as do thick boards used for high fences or sound barriers.

The type of corrugated material used for example in U.S. Pat. No. 3,136,530 would be unsuitable for use in known types of fence rails secured on the sides of the line posts. Hence this material is used in rails extending between the line posts.

It is advantageous, however, to have uninterrupted top and bottom rails secured to the sides of posts and thus avoid on site cutting and fitting fence material between posts.

The present invention attempts to provide a stronger more versatile fence system for use as a fence sound barrier at least double the height of the usual fence.

A further advantage is the provision of a sound barrier with improved integrity and fewer joints thereby having fewer sound leaks due to the fact that continuous interlocking sound panels extend past the line posts.

Versatility is provided by a bracket used to retain the top rail or the bottom rail against movement relative to the post.

Another consideration is the provision of brackets which minimize on-site drilling of post rails or fence material.

The present invention also seeks to provide an improved rail construction having greater strength and providing drainage where lower edges of wood panels rest on the bottom rail.

SUMMARY OF THE INVENTION

The present invention provides a fence post cap and bracket for use in a fence or barrier including line posts, top rails and bottom rails for supporting fencing material the cap comprising a cap for the line post extending beyond the post and having a downwardly extending flange to engage an outer side wall of the top rail remote from the post, and a bracket for supporting the top rail including means on the bracket for securing the bracket to the line post, the bracket having a flange for supporting the top rail and for extending into a channel of the top rail to maintain the top rail against vertical and lateral displacement on the line post.

In the drawings which illustrate preferred embodiments of the invention;

DETAILED DESCRIPTION

Figure 1:
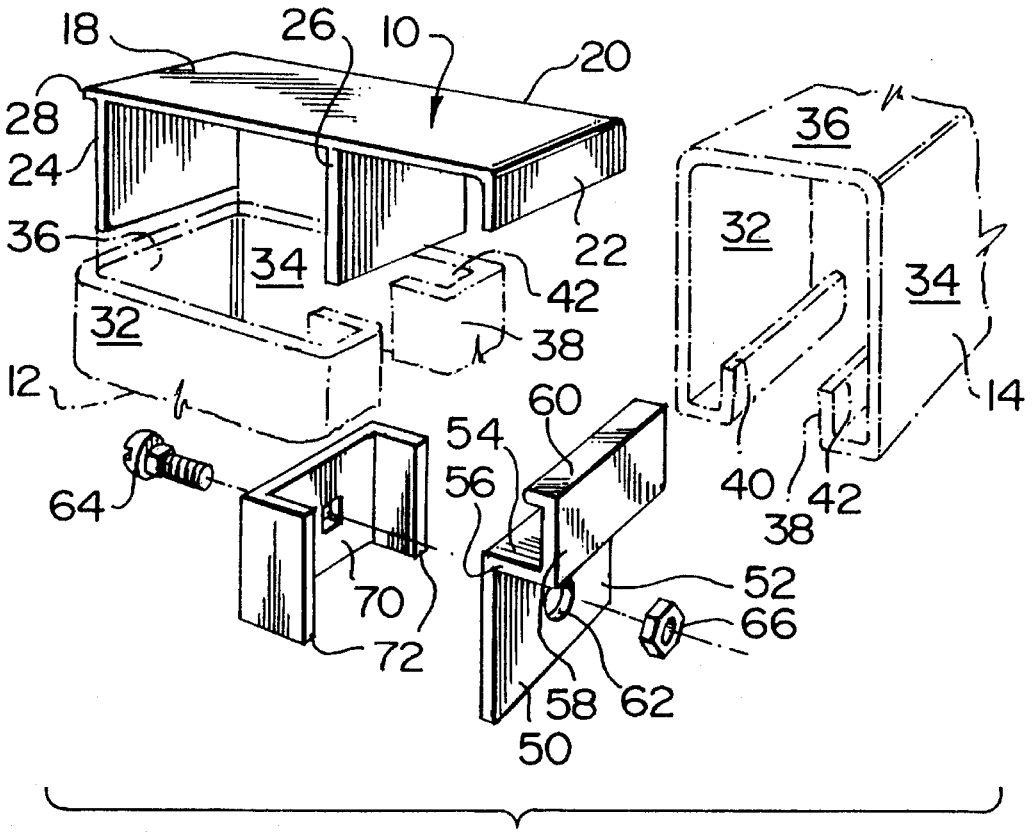
FIG. 1 is an exploded perspective view of the fence rail cap and bracket of this invention.

Referring now in detail to the accompanying drawings, a fence post cap shown generally at 10 in FIG. 1 is adapted to be installed on a fence post 12 and a top rail 14. The cap 10 is preferably an aluminum alloy extrusion and has a top wall 18 dimensioned to cover an open upper end of the post 12. The top wall 18 has an extension 20 overlying the top rail 14. A depending flange 22 on an edge of the cap 10 engages the rail 14 in a manner to be described below.

A depending rib 24 is provided on an underside of the cap 10 adjacent its other edge and a second depending portion 26 is provided intermediate the ends of the cap so that the rib 24 and the depending portion 26 extend into the post 12 when the cap 10 is assembled on the fence. The top wall 18 extends beyond the rib 24 to form a projection 28, which limits the insertion of cap 28 when it is positioned on post 12.

Figure 2:
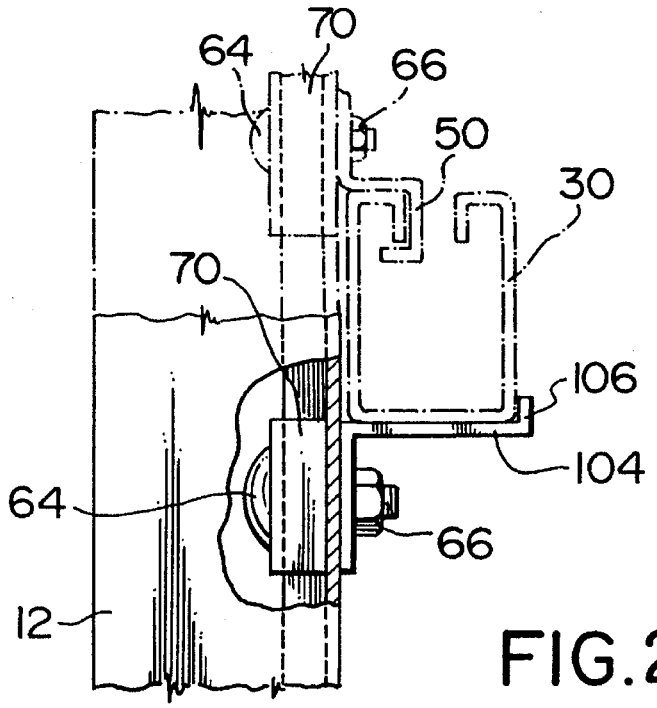
FIG. 2 is a side elevational view partly in section of a bottom rail secured to a line post by the bracket of this invention.
Figure 3:
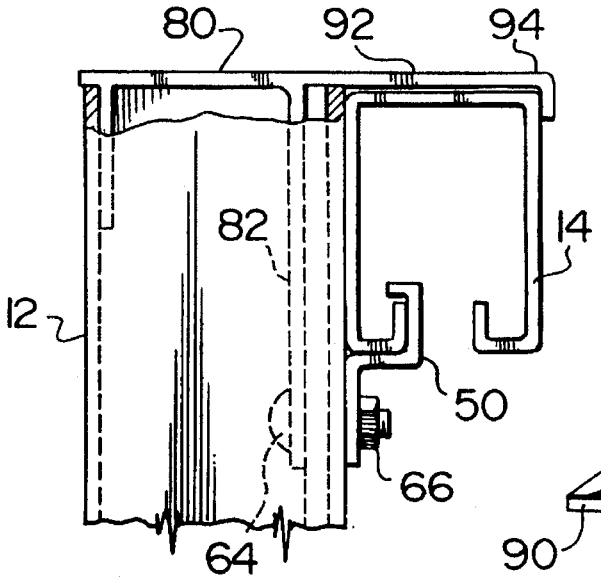
FIG. 3 is a side elevational view of an alternative embodiment of the cap of FIG. 1 in position on a line post.

The posts 12 and rails 14 shown in FIGS. 1 and 3 have identical cross sections and the identical extruded channel material is used on bottom rail 30 as shown in FIG. 2. Only one of the posts 12 and rails 14 or 30 will be described in detail. Briefly the post has a pair of side walls 32 and 34 and a connecting wall 36. Edges of the side walls are turned inwardly to define a opening 38 therebetween and provide flanges 40 and 42 parallel to the walls 32 and 34 respectively.

A bracket 50 is mounted to retain the top rail 14 against vertical movement. The bracket 50 includes a body 52 and a projection 54 formed by three walls 56, 58 and 60. The wall 56 extends outwardly at right angles to the body 52, the wall 58 extends upwardly at right angles to the wall 56 and the wall 60 extends inwardly at a right angle to the wall 58.

The dimensions of the walls 56, 58 and 60 are substantially the same as that of the edges of the side wall 32 of the rail 14 which is turned inwardly to define the channel 38 and the flange 40. The wall 60 is wide enough to engage an edge of the flange 40 when the bracket 50 is in place on the post

12.

The body 52 also has an aperture 62 to receive fastening means in this case, a bolt 64 and a nut 66.

In this embodiment a channel washer 70 is provided on the bolt 64. The channel washer 70 has parallel ribs 72 to engage the flanges 40 and 42 of the post 12. It will be noted that an identical channel washer 70 and bolt will be described below with reference to FIG. 2 which shows the washer 70 positioned on a post 12.

Figure 4:
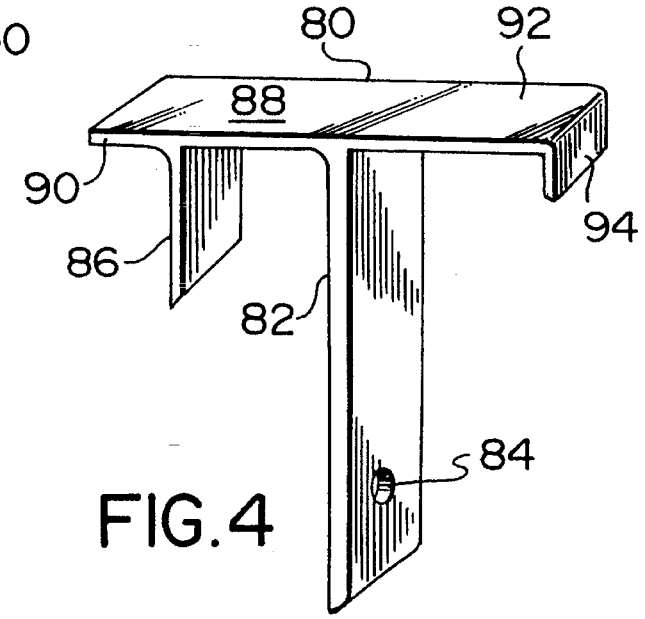
FIG. 4 is a perspective view of the cap of FIG. 3.

FIGS. 3 and 4 illustrate an alternative fence post cap 80 which differs from the cap 10 in that an intermediate depending portion 82 extends into the post 12 and is provided with an aperture 84 to receive the bolt 64 and thus no channel washer 70 is required and the cap 80 is securely retained on the post 12.

The cap 80 has a depending rib 86 and a portion of the top wall 88 extends beyond the rib 86 to provide a projection 90 overlying connecting wall 40 of the post 12 in a manner similar to the cap 10. The cap 80 also has an extension 92 and a depending flange 94 to engage a top rail 14.

As shown in FIG. 2 the bottom rail 30 is secured to the line post 12 by a bottom rail bracket 104 having fastening means 64 and a channel washer 70 described above with reference to FIG. 1.

The bottom rail bracket 104 is preferably an extrusion of right angle cross section having an upturned outer edge 106 to engage an outer wall of the bottom rail 30. A suitable aperture (not shown) in the bracket 104 received the bolt 64. In addition to the bottom rail bracket 104 one of the brackets 50 described above may be used to prevent upward movement of the bottom rail 30. The bracket 50 has a bolt 64, nut 66, and a channel washer 70, and is inverted relative to the bracket 50 described with reference to FIG. 1.

Figure 5:
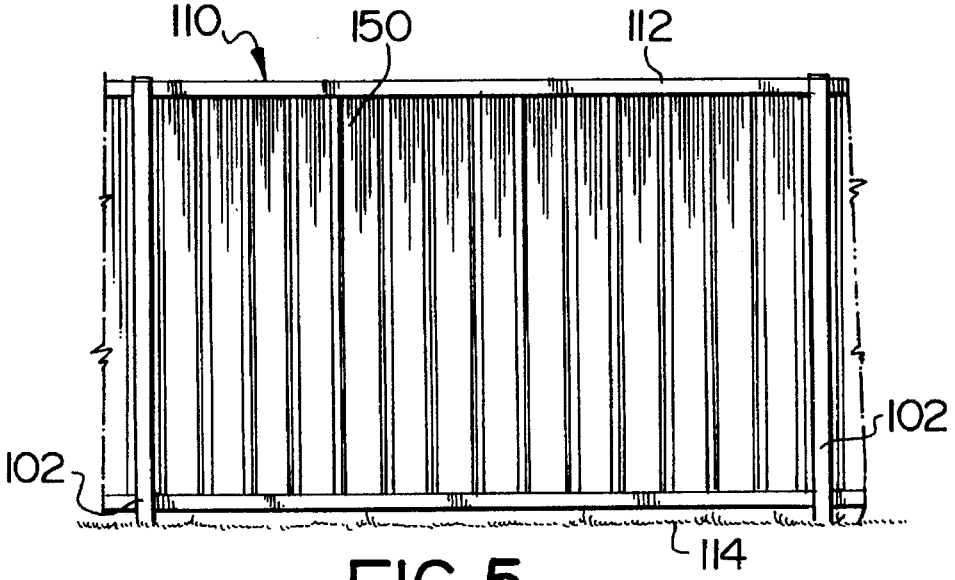
FIG. 5 is a side elevational view of a fence system of this invention including the fence material supported by the posts and rails.
Figure 6:
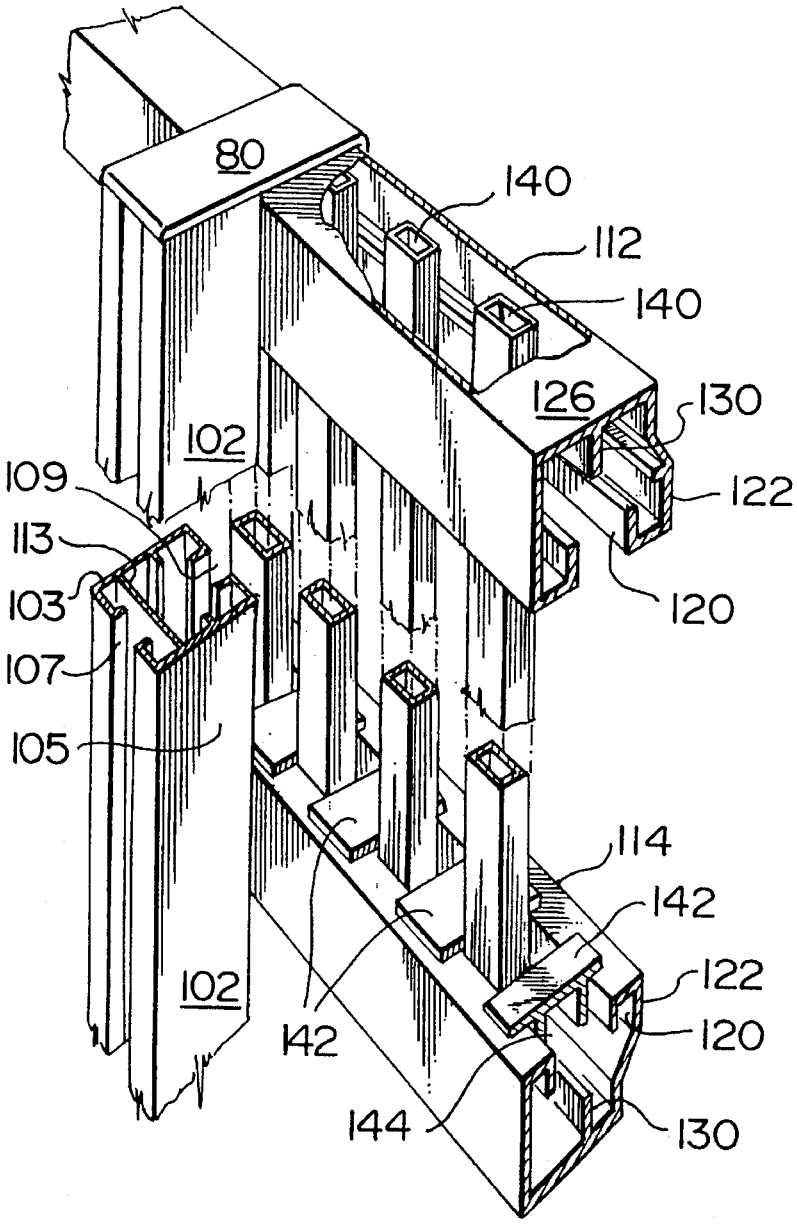
FIG. 6 is a perspective view of an alternative construction of the fence.

FIGS. 5 and 6 illustrate a fence 110 having top and bottom rails 112 and 114 modified to accept fence material 120 of greater thickness than possible using the embodiments of FIGS. 1 and 2. The fence 110 has rails 112 and 114 secured to line posts 102 by brackets 50 and 104 as described. The fence post shown at 102 in FIGS. 5 and 6 are substantially H shaped in cross section. The post 102 has a pair of side walls 103 and 105 defining channels 107 and 109 similar to 38 of the post 12 (see FIG. 1). An integral intermediate connecting wall 113 interconnects the side walls 103 and 105 of the post 102. The cross section of both rails 112 and 114 has also been modified.

First, in order to accommodate thicker material, the channel opening 120 has been widened by bending wall 122 outwardly while retaining the width of connecting wall 126, the same dimension as the cap portion 20 or 92. This provides versatility since all fence material does not require wider rails 112 or 114.

Second, in order to strengthen the wider rails 112 and 114 without excessive use of metal, an internal rib 130 has been provided on the connecting wall 126. It has been found that the rib 130 on the bottom rail 114 has the further advantage that wooden fence material is supported in a manner providing drainage and air circulation thus extending the useful life of boards which might otherwise rot at their lower ends.

In the embodiment illustrated in FIG. 6 the fence material is individual tubular pickets 140 spaced apart by extended metal spacers 142 having legs 144 received in the channels 120 of the top and bottom rails 112 and 114.

Figure 7:
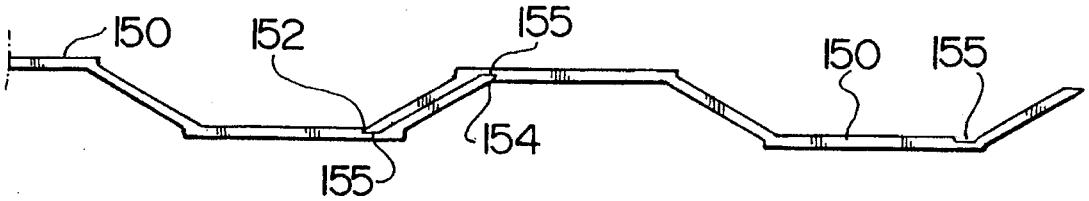
FIG. 7 is a top plan view of the fence material of FIG. 5.

Alternatively the fence material used is corrugated panels 150 two of which are shown in FIG. 7. The panels 150 overlap at their ends 152 or 154 to provide continuous infill for the fence 110. The end of panel 152 is received in groove 155.

Figure 8:
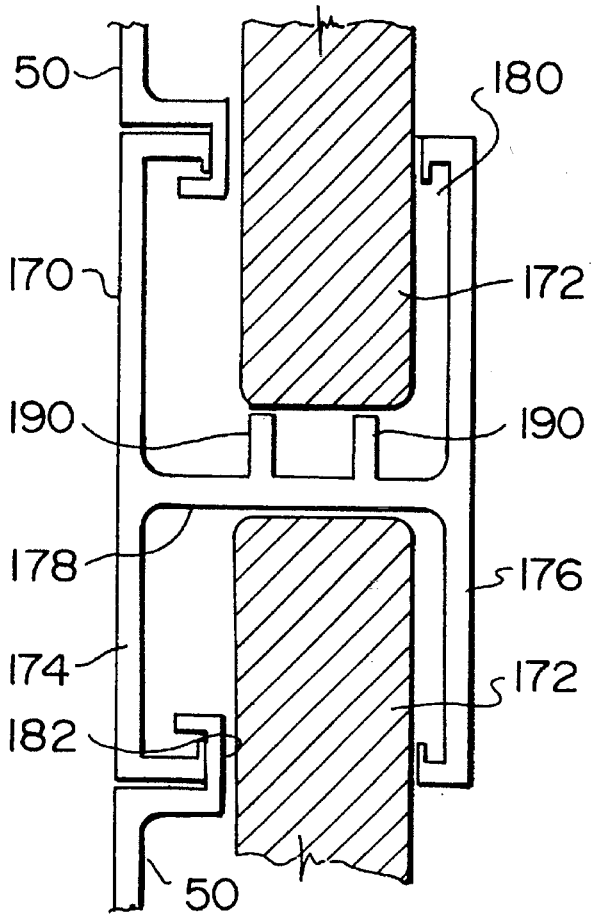
FIG. 8 is an end view of a center rail.
Figure 9:
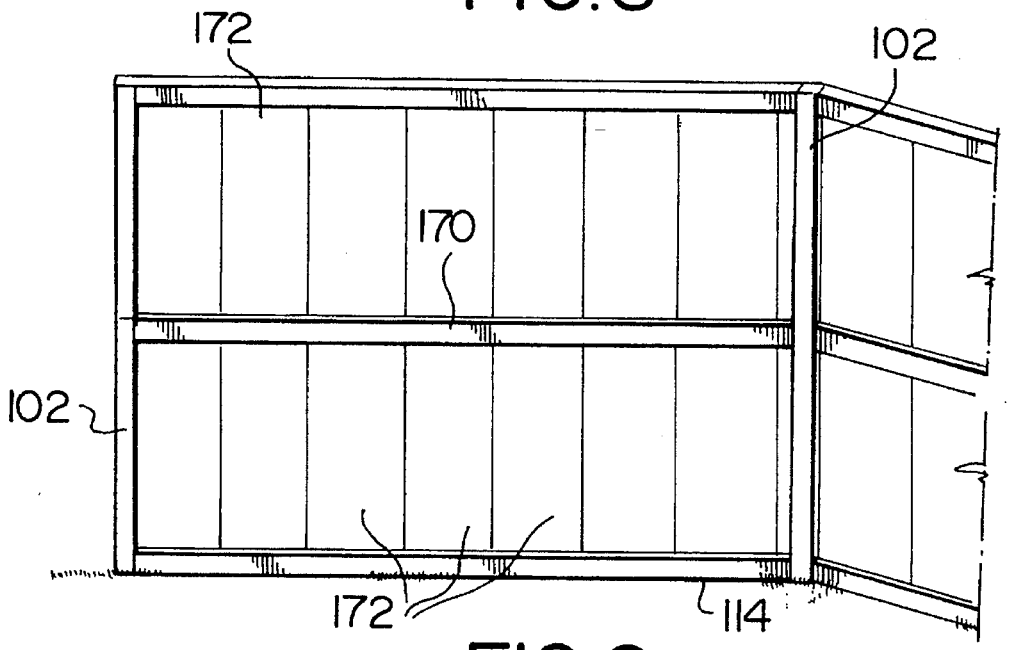
FIG. 9 is a side elevational view of the fence system including the center rail of FIG. 8.

As shown in FIGS. 8 and 9 a center rail 170 is provided for use in fences or barriers of greater height where increasing the thickness of the infill material 172 to obtain rigidity would not be desirable. The center rail 170 has opposed side walls 174 and 176, and an intermediate interconnecting wall 178. The side walls 174 and 176 are bent inwardly to define channels 180 and 182 similar to the channels of the rail 112 described above. A pair of ribs 190 provided on the connecting wall 178 add rigidity to the rail 170 and space the infill material 172 from the bottom of the channel to improve drainage and air circulation.

Center rail 170 is secured to line posts 102 as by two brackets 50 described above and fastened by bolts 64, nuts 66, and channel washers 70 shown in FIG. 1. Top and bottom rails 112 and 114, respectively, are also secured to posts 102 as desribed with reference to FIG. 6.

In use the line posts 12 are set in the ground or in concrete, and bottom rails 30 are secured to the posts 12 as shown in FIG. 2. The bottom rail bracket 104 is secured to the line post 12 by the bolt 64 extending through the channel washer 70 and is retained by a nut 66. Similarly, if desired, a bracket 50 may be installed on the upper portion of the bottom rail 30 using a channel washer 70 and bolt 64 described above.

At this stage the fence installer may insert fence caps 80, having brackets 50 and channel washer 70 loosely attached by bolts 64, in the upper ends of the posts 12. The top rails 14 can be assembled on the caps 80 provided the bracket 50 is not clamped tightly against the post.

If the caps 80 are not fully inserted in the posts, it is convenient to insert the fence material in the channels of the bottom rails 30 and subsequently move the top rail 14 into position so that the upper edge of the fence material will extend into the channel of the top rail 14. The nut 66 associated with the bracket 40 is conveniently tightened by using a conventional box end wrench or the like.

The procedure described above is used for the installation of corrugated panel material such as that shown at 150. It will be noticed that the panels are overlapped so the end edge 152 of the panel 150 engages the recess in the adjacent panel.

The use of pickets 140 as infill material is carried out using much the same procedure as described above with the exception that spacers 142 are snapped into the channel of the top and bottom rails 120 between the pickets 140.

The embodiments of the invention in which an exclusive property or privilege is claimed are defined as follows:

1. A fence system comprising line posts, top rails and bottom rails, said posts and rails having channels therein, said rails extending along side faces of the line posts, said top rail having first and second sidewalls and an interconnecting wall, edges of the first and second sidewalls being turned inwardly to form a pair of flanges having side faces parallel to the respective sidewalls and to define a channel opening between the flanges, fence material received in the channels of the rails and supported by the rails, a cap having a top wall extending beyond the interconnecting wall of the top rail, first and second depending flanges inserted in an upper end of the line post, and third depending flange extending downwardly at an outer edge of the cap to engage the second sidewall of the top rail remote from the line post, and a bracket for supporting the top rail including fastening means extending into the channel of the line post and securing the bracket to the side face of the line post, said bracket having a projection formed by a first wall extending outwardly for supporting the top rail, a second wall at right angle to said first wall extending into the channel opening of the top rail, and a third wall at right angle to the second wall extending over one of the flanges of the top rail a distance approximately equal to the thickness of the flanges to maintain the top rail against vertical and lateral displacements relative to the line post without obstructing the channel opening of the top rail to allow the fence material to be inserted into the channel opening.

2. A fence system as claimed in claim 1, wherein said fastening means on said bracket is a bolt extending through the channel of the line post and a nut and washer received on a threaded end of the bolt.

3. A fence system as claimed in claim 1, wherein the second depending flange of the cap extends into the line post to engage the fastening means on the bracket to secure the bracket to the line post.

4. A fence system as claimed in claim 1, wherein said top rail has the second sidewall flared outwardly to provide a wide channel opening to accommodate thicker fence material.

5. A fence system as claimed in claim 1, wherein said fence material comprises overlapping corrugated panels having side edges received in grooves of adjacent corrugated panels and having end edges of the panels received in the channels of the top and bottom rails.

6. A fence system as claimed in claim 1, wherein said fence material is tubular pickets having their ends received in the channels in the top and bottom rails.

* * * * *